United States Patent [19]
Kwong et al.
[11] 4,284,415
[45] Aug. 18, 1981

[54] ADDITIVES FOR HYDROCARBON OILS

[75] Inventors: Gary W. Y. Kwong, Palatine, Ill.; Joseph Levy, Deerfield Beach, Fla.

[73] Assignee: UOP Inc., Des Plaines, Ill.

[21] Appl. No.: 92,383

[22] Filed: Nov. 8, 1979

[51] Int. Cl.³ ..... C10L 1/22
[52] U.S. Cl. ..... 44/72; 252/51.5 R; 252/403
[58] Field of Search ..... 44/72; 252/403, 51.5 R

[56] References Cited

U.S. PATENT DOCUMENTS 3,017,343 1/1962 Pollitzer ..... 252/403
3,031,504 4/1962 Pollitzer ..... 44/72
3,637,358 1/1972 Cyboi ..... 44/72

*Primary Examiner*—Winston A. Douglas
*Assistant Examiner*—Y. Harris-Smith
*Attorney, Agent, or Firm*—James R. Hoatson, Jr.; Raymond H. Nelson; William H. Page, II

[57] ABSTRACT

An additive for inhibiting sedimentation and retarding degradation of hydrocarbon oils as evidenced by discoloration comprises the reaction product of an alkoxyalkylamine with an epihalohydrin at a temperature from about 40° C. to about 150° C. in the presence of an inorganic base.

13 Claims, No Drawings

ADDITIVES FOR HYDROCARBON OILS

BACKGROUND OF THE INVENTION

Various types of petroleum-derived hydrocarbon oils undergo deterioration on storage or upon exposure to severe conditions. Thus fuel oils such as gasoline, diesel fuel, jet fuel, other aviation fuel, burner oil, furnace oil, kerosene, and naptha, for example, and other oils such as lubrication oils, cutting oils, slushing oils, etc., undergo deterioration as evidenced by such changes as, for example, formation of sediment and discoloration.

Sediment formation is undesirable for various reasons. When formed in tanks storing hydrocarbon oils the settling of accumulated particles requires periodic draining and cleaning of storage tanks, leading to temporary unavailability to storage capacity, substantial diversion of manpower, and waste disposal problems. Sediment formation in burner oil tends to plug strainers, burner tips, injectors, etc. In diesel fuel such sediment tends to form sludge and varnish in the engine. If the oil is used as a heat exchange medium, as for example with jet fuel, the sediment tends to plug exchanger coils. In gasoline the sediment may tend to deposit on sensitive parts in an internal combustion engine, such as carburetors, thereby decreasing the efficiency of combustion and causing increased fuel consumption.

It is apparent, therefore, that reduced sediment formation in hydrocarbon oils is desirable. One method of effecting such reduction would be to eliminate, to a substantial degree, those processes leading to particulate formation, such as oxidation. Another method would be to prevent agglomeration and/or settling of the formed particulate matter by effectively maintaining the fine particulates in a well dispersed state, for when the particulates are so dispersed the aforementioned difficulties associated with sediment formation either do not occur or are of substantially lessened severity.

Discoloration of hydrocarbon oils is undesirable because it is an indication that degradation has occurred or is occurring, hence there is a marked customer preference for lighter oils. Thus there is an economic incentive for minimizing discoloration and degradation of hydrocarbon oils, especially during long-term storage.

SUMMARY OF THE INVENTION

An object of this invention is to prevent deterioration of hydrocarbon oils, as evidenced especially by sediment formation and discoloration, by the incorporation of minor amounts of a suitable additive. In one embodiment of this invention said additive comprises the product formed by reacting an alkoxyalkylamine with an epihalohydrin at a temperature of from about 40° C. to about 150° C. and removing liberated halogen with an inorganic base. In another embodiment the additive comprises the product formed by reacting an alkoxyalkyldiamine with an epihalohydrin at a temperature from about 40° C. to about 150° C. and removing liberated halogen with an inorganic base. In a more specific embodiment said ephihalohydrin is epichlorohydrin. In a still more specific embodiment said alkoxyalkyldiamine is an alkoxypropyl-1,3-propylenediamine and said epihalohydrin is epichlorohydrin.

DESCRIPTION OF THE INVENTION

Hydrocarbon oils are stored and utilized under a diversity of temperatures. Consequently it is desirable that additives which may be incorporated in said oils have the attribute of ease of pumpability even at a low temperature. Among the physical attributes assuring facile pumping are a relatively low pour point and a suitable viscosity at low temperatures. Another desirable attribute of additives which inhibit sedimentation is that they exhibit enhanced dispersant capability toward particulates but minimal dispersant capability toward water, for it is preferable to leave water as a separate phase in hydrocarbon oils. The reaction products of this invention have been discovered to act as superior sedimentation inhibitors while having low pour points, desirable viscosities, and low dispersability toward water. Additionally, the reaction products of this invention when used as additives to hydrocarbon oils effectively retard their discoloration. Because of their structure, other uses which may be anticipated for said reaction products include applications as antifoulants, carburetor detergents, lubricant additives, and corrosion inhibitors.

The additives of this invention are reaction products of an alkoxyalkylamine with an epihalohydrin at a temperature from about 40° C. to about 150° C. in the presence of an inorganic base. Generally the reaction is conducted in a high-boiling aromatic solvent for ease of manipulation. However, a solvent may be dispensed with, although the results are not necessarily equivalent. Examples of solvents which may be employed include toluene, the xylenes, ethylbenzene, mesitylene, and other alkyl-and polyalkylbenzenes.

The term alkoxyalkylamines as set forth in the specification and appended claims will include primary amines and will include monoamines, diamines, triamines, etc. Where monoamines are used the amine can be represented as $ROR_1NH_2$. The alkoxy group, RO, of such monoamines contains from about 1 to 25 carbon atoms, but preferably from about 6 to about 20 carbon atoms. Suitable groups representative of the carbonaceous portion of the portion of the alkoxy group include methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, and pentacosyl moieties. Such groups commonly have their commercial origin in fatty acids and petroleum-derived alcohols, and consequently are often supplied as mixtures. Therefore it is to be understood that amines containing a combination of the aforementioned groups are explicitly within the scope of this invention.

When the carbonaceous portion of the alkoxy group is derived from fatty acids the major portion is an unbranched aliphatic group. When the carbonaceous portion comes from petroleum-derived olefins, the major portion generally is a branched aliphatic group. In each case minor amounts of unsaturated material may be present. Therefore it is to be understood explicitly that the carbonaceous portion of the alkoxy group of the alkoxyalkylamines of this invention may be comprised of either a major portion of unbranched or branched aliphatic groups which may contain minor amounts of unsaturation.

The alkyl group, $R_1$, of the alkoxyalkylamines used in this invention is an alkylene group containing from 2 to about 10 carbon atoms. Examples of alkylene groups which are suitable include ethylene, propylene, butylene, amylene, hexylene, heptylene, octylene, nonylene, and decylene. In a preferred embodiment the alkylene group is propylene. Although such alkylene groups generally are unsubstituted, branched alkylene groups may be employed, but not necessarily with equivalent results. Examples of the latter include isopropylene, sec-butylene, iso-butylene, sec-amylene, iso-amylene, etc.

It is a discovery of this invention that diamines, triamines, tetramines, etc., may be employed advatageously. In the case of diamines the structure may be represented as $ROR_1NHR_2NH_2$, where RO and $R_1$ are described in the same way as was set forth above for the monoamines. The group $R_2$ is, like $R_1$, an alkylene group with the same description as $R_1$ as set forth above. $R_1$ and $R_2$ may be the same or may be different. In a preferred embodiment both $R_1$ and $R_2$ are propylene groups.

In a like manner the triamines can be represented as $ROR_1NHR_2NHR_3NH_2$, the tetramines as $ROR_1NHR_2NHR_3NHR_4NH_2$, the pentamines as $ROR_1NHR_2NHR_3NHR_4NHR_5NH_2$, etc., with a general formula of $ROR_1(NHR_2)_mNH_2$, where m is the number of amino groups present in the polyamine and is an integer less than about 10. The description of RO and $R_1$ conforms to that hereinbefore given. In the embodiment where m is equal to or greater than 2, the group $R_2$ is an alkylene group otherwise conforming to the description hereinbefore set forth for $R_1$. Examples of such amines include alkoxyalkyl diethylenetriamines, alkoxyalkyl triethylenetetramines, alkoxyalkyl polyethyleneimines, alkoxyalkyl dipropylenetriamines, etc.

Just as the alkoxy group may contain a combination of carbonaceous groupings, so may the diamines, triamines, etc. contain a combination of polyamines. Therefore, it is to be understood that this invention encompasses all mixtures of amines whose individual components conform to the description set forth above.

The amine or mixture of amines is reacted with an epihalohydrin. In the preferred embodiment of the invention epichlorohydrin is utilized, although epibromohydrin and epiiodohydrin may be used, but not necessarily with equivalent results in every case. Other epihalohydrins which may be employed in this invention include 1-chloro-3,4-epoxybutane, 1-chloro-2,3-epoxybutane, 1-chloro-4,5-epoxypentane, 1-chloro-3,4-epoxypentane, etc., and the corresponding bromo and iodo compounds. Suitable condensation products may also be obtained when using a mixture of epihalohydrins, where each of the components meet the qualifications set forth above. The amount of epihalohydrin used ranges from about 0.5 to about 2 moles per mole of amine.

The preparation of the reaction products of this invention is effected by contacting the epihalohydrin and amine, generally in a high boiling aromatic solvent, at a suitable temperature, and thereafter removing the halide which forms with an inorganic base. Generally the reaction may be conducted at a temperature from about 40° C. to about 150° C., a preferred temperature range being from about 60° C. to about 125° C. Inorganic bases suitable for use in the process of this invention include the alkali metal hydroxides and carbonates and the alkaline earth oxides, hydroxides, and carbonates. Examples of such materials, cited for illustrative purposes only, are the hydroxides and carbonates of lithium, sodium, potassium, rubidium and caesium, magnesium oxide, magnesium hydroxide, magnesium carbonate, calcium oxide, calcium hydroxide, calcium carbonate, barium oxide, barium hydroxide, and barium carbonate. Where the epihalohydrin is used in up to equal molar proportions of the amine, then the molar amount of base employed is approximately equal to that of the amine, although an excess of base over amine up to about 50% often may be employed advantageously. Where the epihalohydrin is used in greater than molar proportions relative to amine, then the molar amount of base is about equal to that of epihalohydrin although an excess up to about 50% may be used.

The mode of preparation of the condensation products of this invention is susceptible to numerous variations on the theme of reacting the amine with the epihalohydrin under reaction conditions. An example of one general mode is the addition of epihalohydrin to a solution of the amine in a suitable solvent, generally a high-boiling aromatic compound or mixtures thereof. Reaction between the components occurs to a given acidity, or given amount of amine hydrohalide formation, at which time either aqueous or solid inorganic base is added to remove the halide thus formed. The primary reaction product therefrom undergoes further condensation leading to the ultimate reaction product.

An example of another mode of preparation is the concurrent addition of epihalohydrin and amine to the solvent employed at a suitable temperature. When reaction has occurred to a desired amount of acidity, aqueuos or solid inorganic base is added and the liberated primary reaction product thereupon undergoes further condensation leading to the ultimate reaction product.

In still another method of preparation, the epihalohydrin and amine are added concurrently to the solvent containing a portion of the inorganic base employed. The base may be either in solution or as a solid. After reaction has occurred to a given amount of acidity the remaining portion of solid or aqueous base is added and the primary reaction product thereupon undergoes further condensation leading to the ultimate reaction products.

The reaction products of this invention may be used as additives for many kinds of hydrocarbon oils. These additives are especially advantageous when used with fuel oils. Examples of such fuel oils include gasoline, diesel fuel, jet fuel, other aviation fuel, burner oil, furnace oil, kerosene, and naphtha. Examples of other oils in which the reaction products of this invention may be employed include lubricating oils, cutting oils, slushing oils, etc. Said additives may be employed in a concentration from about 0.0001% to about 1% by weight, depending upon the nature of the hydrocarbon oil, its source, its intended use, its history, etc.

The following examples are merely illustrative of this invention, and it is to be understood that the invention is not necessarily limited thereby.

EXAMPLE 1

Epichlorohydrin (83.2 g, 0.90 mol) was added dropwise over about 50 minutes to a stirred, pale yellow-solution, initially at about 90° C., of tridecyloxypropylamine (280.4 g, 105 mole), dissolved in 222 g of Espesol 3BC. The latter is the trade name for high boiling bottoms from xylene fractionation as supplied by Charter Oil Co. The solution was stirred about 1.5 hours at 94°-110° C., after which a solution of 20% aqueous sodium hydroxide containing 0.99 mol of base was added over about 40 minutes while the reaction temperature was maintained at 86°-94° C. The mixture was stirred about 2.5 hours at 86°-91° C., and an additional 0.09 mole of base water was added. The mixture was cooled, layers were separated, and the organic phase was filtered to give a clear, amber solution (544 g) which contained 53.2% active ingredient by the nitrogen jet gum method. ANSI/ASTM D 381-70 modified in that nitrogen is used as the gas.

EXAMPLE 2

Epichlorohydrin (0.240 mol) was added over 50 minutes to a pale yellow solution of N-tridecyloxypropyl-1,3-propylenediamine, (0.26 mol) in 60 g of the aforementioned solvent at 76°-80° C. The mixture was stirred at 77°-83° C. for about 30 minutes, and 0.26 mol of a 20% aqueous sodium hydroxide solution as added over 15 minutes. Stirring at 78°-83° C. was continued about 1.8 hours, an additional 0.024 mole of base was added, and the mixture was stirred an additional 0.5 hours at 82°-83° C. Finally layers were separated, 10 g xylene was added to the organic phase, and water was removed by axeotropic distillation to give 152 g (96%) of a clear yellow solution containing 54% of active ingredient.

EXAMPLE 3

Tridecyloxypropylamine (0.750 mol) and epichlorohydrin (0.712 mol) were added separately but concurrently to a stirred mixture of Espesol 3BC (160 g.) and 22% aqueous sodium hydroxide containing 0.0712 mol of base at 73°-83° C. over a period of 1.5 hours. After an additional 10 minutes at 80° C., 22% aqueous sodium hydroxide containing 0.712 mol of base was added over 13 minutes. The mixture was stirred at 78°-87° C. for 1 hour, than at 110° C. for 2 hours. Layers were separated and the organic phase was filtered to give 387 g. (97%) of a solution containing 53.4% of active ingredients.

EXAMPLE 4

N-Tridecyloxypropyl-1,3-propylenediamine (0.740 mol) and epichlorohydrin (0.70 mols) were added concurrently over about 40 minutes to a mixture of Espesol 3BC (172 g) and 22% aqueous sodium hydroxide containing 0.070 mole of base at 75°-90° C. After 8 minutes additional 22% aqueous sodium hydroxide (0.70 mole of base) was added over 15 minutes. The temperature was increased to 110° C. over 1 hour and the mixture was stirred for 2 additional hours at that temperature. Layers were separated, 15 g of xylene was added to the organic phase, and water was removed by azeotropic distillation to give 423 g (97%) of a light amber solution containing 53% of active ingredient.

EXAMPLE 5

An alkoxypropyl-1,3-propylenediamine mixture rich in $C_{12}$-$C_{15}$ groupings, (0.594 mol) and epichlorohydrin (0.56 mol) were added concurrently over a period of 1 hour to a mixture of 137 g. Espesol 3BC and 22% aqueous sodium hydroxide (0.56 mol) at 71°-91° C. After 5 minutes 0.56 mol of additional base, as a 22% aqueous solution was added with stirring at 83°-92° C. over 13 minutes. The temperature was raised to 108° C. and the mixture was stirred at 106°-109° C. for about 3¼ hours. Layers were separated, 15 g xylene was added to the organic phase and water was removed by azeotropic distillation to give 361 g. (96%) of a clear yellow solution containing 54.3% active ingredient.

EXAMPLE 6

In this example are collected several representative products prepared according to the process of this invention. All reaction products were used at a concentration of 17 ppm in the same fuel oil. Their efficacy in inhibiting sedimentation and discoloration was determined by an accelerated storage stability test conducted as follows. One liter of oil was poured into a flask containing four sandblasted steel strips. Oxygen was blown into the flask for 5 minutes and the flask was stoppered securely, then heated at 212° F. for 16 hours. The flask was cooled for 1 hour and the oil was filtered through a weighed AA millipore filter disc, the color of the filtrate being measured. The flask and steel strips were washed with a solvent such as isooctane, the washings were filtered through the same filter disc, and the filter disc and material collected thereon were washed with a separate portion of solvent. The disc was then heated at 95° C. to remove solvent, after which the disc was cooled and its weight taken to determine the weight of sediment thereon.

The change in color was determined from the absorbance of the sample before and after heating. Material which tends to prevent discoloration will show a smaller change in absorbance than a blank sample, i.e., one in which the fuel oil has no additives. The efficiency of the reaction products of this invention in preventing discoloration was determined, at the same weight-weight concentration, relative to Polyflo 130, the trade name of a commercial product of UOP, Inc., by comparing the difference between the absorbance of the blank, $A_{blank}$, and that containing the reaction products of this invention, A, with that of the standard, $A_{130}$, using the formula:

$$\text{relative efficiency} = \frac{A_{blank} - A}{A_{blank} - A_{130}}$$

Values greater than one show the material is superior to the standard in retarding discoloration.

The weight of sediment observed in the presence of various additive materials is a direct measure of their inhibitory tendencies toward sediment formation. A comparison of the efficacy of the materials of this invention with that of the successful commercial product Polyflo 130 is the ratio of weight of sediment formed in the presence of Polyflo to the weight formed in the presence of the materials of this invention at the same weight-weight concentration. .

Physical Properties and Inhibitor Efficiency of Additives

| Amine | Ratio Epichlorohydrin to Amine | RELATIVE EFFICIENCY Sedimentation Inhibition | Discoloration |
|---|---|---|---|
| $C_6O(CH_2)_3NH_2$ | .95 | .7 | 0.8 |
| $C_{8-10}O(CH_2)_3NH_2$ | .95 | 1.0 | 0.6 |
| $C_{8-10}O(CH_2)_3NH(CH_2)_3NH_2$ | .95 | 1.3 | 1.7 |
| $C_{10}O(CH_2)_3NH(CH_2)_3NH_2$ | .92 | 1.2 | 1.1 |
| $C_{12-15}O(CH_2)_3NH(CH_2)_3NH_2$ | | 1.0 | 1.0 |
| $C_{13}O(CH_2)_3NH(CH_2)_3NH_2$ | 1.03 | 1.3 | 1.3 |
| $C_{13}O(CH_2)_3NH(CH_2)_3NH_2$ | .95 | 1.7 | 1.3 |
| $C_{13}O(CH_2)_3NH(CH_2)_3NH_2$ | .92 | 2.5 | 1.0 |
| $C_{13}O(CH_2)_3NH(CH_2)_3NH_2$ | .94 | 5.0 | 1.2 |
| $C_{13}O(CH_2)_3NH(CH_2)_3NH_2$ | 1.03 | 1.4 | 1.3 |

We claim as our invention:

1. A composition comprising a major amount of a hydrocarbon oil containing from about 0.0001% to about 1% of the reaction product of 1 molar proportion of an alkoxyalkylamine, wherein said amine is a primary amine, said alkoxy group contains from about 1 to about 25 carbon atoms, and said alkyl group is an alkylene containing 2 to about 10 carbon atoms, with about 0.5 to about 2.0 molar proportions of an epihalohydrin selected from the group consisting of epihalohydrin, 1-halo-3,4-epoxybutane, 1-halo-2,3-epoxybutane, 1-halo-4,5-epoxypentane, and 1-halo-3,4-epoxypentane, at a temperature from about 40° C. to about 150° C. in the presence of an inorganic base.

2. The composition of claim 1 wherein said hydrocarbon oil is a fuel oil.

3. The composition of claim 2 wherein said fuel oil is selected from the group consisting of gasoline, diesel fuel, jet fuel, other aviation fuel, burner oil, furnace oil, kerosene, and naphtha.

4. The composition of claim 1 wherein said epihalohydrin is epichlorohydrin.

5. The composition of claim 4 wherein said molar proportion of epichlorohydrin is from about 0.7 to about 1.2.

6. The composition of claim 5 wherein the reaction product is formed at a temperature from about 60° C. to about 125° C.

7. The composition of claim 6 wherein said alkoxyalkylamine is an alkoxypropylamine wherein said alkoxy group contains from about 6 to about 20 carbon atoms.

8. The composition of claim 6 wherein said alkoxyalkylamine is an alkoxypropyl-1,3-propylenediamine wherein said alkoxy group contains from about 6 to about 20 carbon atoms.

9. A method of inhibiting sedimentation and discoloration of hydrocarbon oils comprising dissolving therein an amount from about 0.0001% to about 1% of the reaction product of 1 molar proportion of an alkoxyalkylamine, wherein said amine is a primary amine, said alkoxy group contains from about 1 to about 25 carbon atoms, and said alkyl group is an alkylene group containing 2 to about 10 carbon atoms, with about 0.5 to about 2.0 molar proportions of an epihalohydrin selected from the group consisting of epihalohydrin 1-halo-3,4-epoxybutane, 1-halo-2,3-epoxybutane, 1-halo-4,5-epoxypentane, and 1-halo-3,4-epoxypentane, at a temperature from about 40° C. to about 150° C. in the presence of an inorganic base.

10. The method of claim 9 wherein said epihalohydrin is epichlorohydrin used in a molar proportion from about 0.7 to about 1.2.

11. The method of claim 10 wherein the reaction product is formed at a temperature from about 60° C. to about 125° C.

12. The method of claim 11 wherein said alkoxyalkylamine is an alkoxypropylamine wherein said alkoxy group contains from about 6 to 20 carbon atoms.

13. The method of claim 10 wherein said alkoxyalkylamine is an alkoxypropyl-1,3-propylenediamine wherein said alkoxy group contains from about 6 to about 20 carbon atoms.

* * * * *